US010352141B2

(12) United States Patent
Pich et al.

(10) Patent No.: US 10,352,141 B2
(45) Date of Patent: Jul. 16, 2019

(54) DEVICE FOR REGULATING INJECTION PRESSURE IN ENHANCED OIL RECOVERY

(71) Applicant: S.P.C.M. SA, Andrezieux Boutheon (FR)

(72) Inventors: Emmanuel Pich, Saint Priest en Jarez (FR); Julien Bonnier, Andrezieux Boutheon (FR)

(73) Assignee: S.P.C.M. SA (FR)

( * ) Notice: Subject to any disclaimer, the term of this patent is extended or adjusted under 35 U.S.C. 154(b) by 242 days.

(21) Appl. No.: 15/049,575

(22) Filed: Feb. 22, 2016

(65) Prior Publication Data

US 2016/0168954 A1 Jun. 16, 2016

(30) Foreign Application Priority Data

Dec. 23, 2015 (FR) ..... 15 63188

(51) Int. Cl.
*E21B 43/16* (2006.01)

(52) U.S. Cl.
CPC ..... *E21B 43/16* (2013.01)

(58) Field of Classification Search
CPC ..... E21B 43/16; E21B 43/20; E21B 41/00; E21B 34/02
See application file for complete search history.

(56) References Cited

U.S. PATENT DOCUMENTS

| | | | | |
|---|---|---|---|---|
| 3,477,467 | A * | 11/1969 | Sewell | F16K 13/10 137/601.19 |
| 4,510,993 | A | 4/1985 | Luetzelschwab | |
| 4,553,594 | A | 11/1985 | Luetzelschwab | |
| 4,782,847 | A * | 11/1988 | Luetzelschwab | E21B 43/20 137/13 |
| 8,607,869 | B2 * | 12/2013 | Soucy | E21B 43/20 166/305.1 |
| 2012/0292029 | A1 * | 11/2012 | Soucy | E21B 43/16 166/305.1 |
| 2015/0041143 | A1 * | 2/2015 | Remy | E21B 17/00 166/335 |
| 2016/0168954 | A1 * | 6/2016 | Pich | E21B 43/16 166/250.01 |

FOREIGN PATENT DOCUMENTS

| | | | | |
|---|---|---|---|---|
| CA | 2920032 | A1 * | 4/2016 | E21B 43/16 |
| GB | 201418763 | * | 12/2014 | E21B 17/20 |

* cited by examiner

*Primary Examiner* — Jennifer H Gay
(74) *Attorney, Agent, or Firm* — Forge IP, PLLC

(57) ABSTRACT

A pressure regulating device for the injection of an aqueous polymer solution into an oil well, the device consisting of a series of straight tubes each with a pressure gauge, each tube being separated by a valve, where the valves are gate valves and/or needle valves. A method to reduce the injection pressure of an aqueous polymer solution according to the pressure of the well using the device.

7 Claims, 1 Drawing Sheet

DEVICE FOR REGULATING INJECTION PRESSURE IN ENHANCED OIL RECOVERY

FIELD OF THE INVENTION

Enhanced oil recovery (EOR) by the injection of viscous polymer solutions takes place with certain difficulties due to the potential for mechanical degradation of the polymer.

The polymers used, in particular polyacrylamides, undergo molecular weight degradation when subjected to a shear force. This degradation increases with increasing molecular weight and decreasing polymer concentration.

BACKGROUND OF THE INVENTION

From the 1970s to the 1980s, after the first oil crisis, EOR was developed in the United States with the use of low molecular weight polymers (around 10 million Daltons).

In the 1990s, significant research was carried out into increasing the molecular weights in order to obtain higher viscosities with a low dosage. Today, in this application, the molecular weights are greater than 20 million with high sensitivity to mechanical degradation in that they are injected at a low concentration of 50 to 2,000 ppm.

An oil field comprises between 10 and several thousand secondary recovery water injection wells, the primary recovery method being autogenous oil production.

When a polymer solution is to be injected into a field where water is injected, a concentrated stock solution is first prepared, usually having 0.5 to 2% of a high molecular weight polymer.

This solution is then distributed at 50-2000 parts per million to be injected by various methods.

Usually, within an oil field, a single water injection pump supplies several wells. But because of the heterogeneity of the fields, injection pressures differ from one well to another. For this reason a pressure control or regulating valve at the wellhead is installed (called a choke valve). The polymer solution cannot pass through this choke without degradation, which increases as the pressure falls, in a disproportionate manner from a $\Delta P$ of about 20 to 30 bars.

These various types of choke do not allow for the necessary pressure reduction in a polymer solution, without degradation, which becomes almost exponential with increasing pressure.

To remedy this degradation problem, mechanical equipment has been used:

- The stock solution and water at low pressure are pumped by a high pressure positive displacement pump at a rate such that the well pressure is maintained;
- The water and the polymer at the final pressure are mixed at high pressure, this solution passing through a calibrated tube of suitable length thus creating the necessary pressure reduction without degrading the polymer. In this equipment, the degradation with pressure differences of 50 bars, the speed of the solution with a standard concentration of 1000-2000 ppm and a molecular weight of 20 million should not exceed about 11 m/s (U.S. patent 2015/0041143);
- The mixture may also be passed through a positive displacement pump, for example a gear-driven pump, whose speed and therefore flow are controlled by a hydraulic or electric brake.

In the 1980s, Marathon filed two patents that are interesting in principle but not very adaptable to current field conditions:

- U.S. Pat. No. 4,782,847 uses a needle valve and tube sections with restrictions that give rise to the Vortex effect. Tests conducted with oil companies on low viscosity (<20 cps) dilute solutions (1000 ppm) of polymers having molecular weights of 20 million allowed the needle valve to reduce the pressure by 7 to 10 bars with a degradation of no more than 2%. The Vortex orifices and the needle valve do not allow for permanent adjustment at a well where the variation over time can be 50 bars. The system must therefore be dismantled in order to adjust the vortex sleeves, which is not possible in large fields.
- U.S. Pat. No. 4,510,993 uses a single needle valve or needle compensation system, but has more important limitations than the above patent.

An oil company currently requires:

- A degradation at 50 bars of a maximum of 10% of the viscosity (sometimes 5%);
- With viscosities in the range of 3 to 30 cps much more degradable than concentrated solutions;
- With polymer concentrations from 50 to 2000 ppm giving widely varying viscosity due to the effect of the salinity on the viscosity.

Today, there are fields using more than 50,000 ppm of NaCl:

- With equipment not requiring dismantling for many years (an EOR can last from 10 to 20 years);
- The variation in pressure can be implemented in a very simple manner at the wellhead;
- And a pressure variation at a well of at least 50 bars.

These are conditions which did not exist in the 1980s and it would be illusory today to use a needle valve or an in-line piston and needle valve as described in U.S. Pat. No. 4,553,594.

To compensate for the problems of the prior art, the Assignee has developed a system based upon multiple gate or needle valves each separated by straight lengths of tube.

SUMMARY OF THE INVENTION

The object of the invention is therefore a pressure regulating device for the injection of an aqueous polymer solution into an oil well, said device consisting of a series of straight tubes each with a pressure gauge, each tube being separated by a valve.

The device is characterized in that the valves are gate valves and/or needle valves.

Intermediate pressure gauges are used to distribute the pressure reductions in order to obtain minimum degradation. Obviously, this degradation will depend upon the flow rate and it will therefore be necessary to calculate the diameters in order not to exceed the degradation limiting speed as a function of the composition of the solution.

The length of the straight tubes can be very small, preferably between 10 and 50 centimeters.

In practice the straight tubes and valves are made of stainless steels, in particular austenitic-ferritic steels called "superduplex" or surface-hardened austenitic steels (vacuum nitriding, Kolsterising) having high mechanical strength and high corrosion resistance. The use of "superduplex" high strength austenitic-ferritic steels leads to a reduction in the erosion caused by vortex cavitation.

When the pressure device of the invention contains gate valves, the straight tubes connected to the valves have a diameter that is larger than the passageway of the valve, thus allowing for the vortex effect.

When the pressure device of the invention contains needle valves, the vortex effect is minimal. The valves alone allow the injection pressure to be regulated.

The conditions for each oil well are highly variable:

Well injection pressure;

Necessary pressure reduction;

Difference in pressure between the injected water and the pressure of the well;

Water salinity, especially its $Na^+$, $Ca^{2+}$, $Mg^{2+}$ salt contents, which strongly influence the viscosity;

Water temperature;

Viscosity to be achieved;

Acceptable degradation, etc.

Tests are absolutely necessary to determine the diameter, the number of straight tubes and the length of the device. To avoid degradation with a high pressure drop (50 bar), the device consists for example of 6 straight vortex effect lengths of tube and 5 gate valves, thus leading to minimal degradation of the polymer.

In practice, the number of valves is between 3 and 20, preferably from 5 to 15.

The object of the invention is also a method for reducing the injection pressure of an aqueous polymer solution as a function of well pressure by implementing the previously described device within an enhanced oil recovery method.

More specifically, the method according to the invention comprises the following steps:

calculating the required pressure reduction ΔP by subtracting the injection pressure at the wellhead from the pressure of the main injection pump;

determining the diameter, the number of straight tubes and the length of the pressure regulating device at the specific flow rate, by means of workshop tests;

injecting the aqueous polymer solution into the main pipeline;

adjusting the pressure drop per straight tube and associated valve by means of measuring the pressure at each straight tube using the pressure gauge and by means of balancing said pressure drop between the straight tubes using various valves.

Upon injection the device can be adjusted to the required pressure with ease, either manually or by means of a PLC, thus giving the necessary injection value.

The method produces a viscosity degradation of less than 10%, preferably less than 5%.

The pressure regulating device according to the invention is preferably positioned downstream of the collector (manifold).

A person skilled in the art may make adjustments to the device and to the method for each individual case. A person skilled in the art may thus combine the various options described above in order to achieve the desired result. In particular, the reduction in degradation can be obtained by increasing the number of valves for the same flow rate, at the same time reducing the valve pressure drop.

BRIEF DESCRIPTION OF THE DRAWINGS

The invention and resulting benefits will become clear from the following examples supported by the attached figures.

DETAILED DESCRIPTION OF THE INVENTION

Example No. 1

Figure 1:
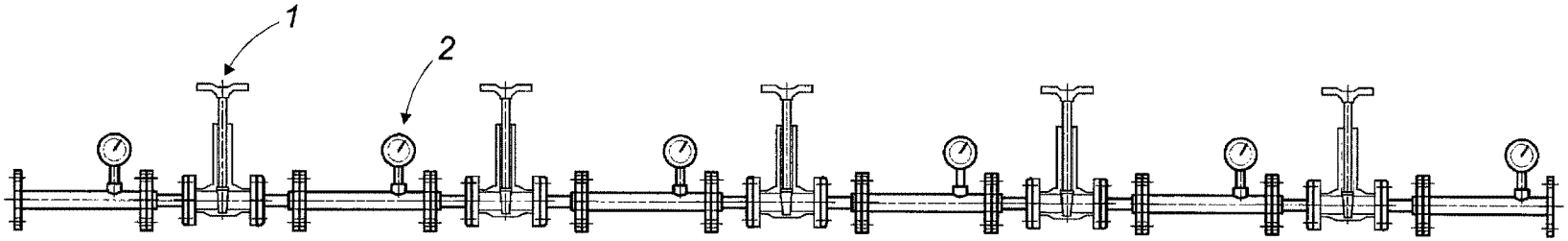
FIG. 1 shows an example of the device with gate valves (1) and intermediate pressure gauges (2).
Figure 2:
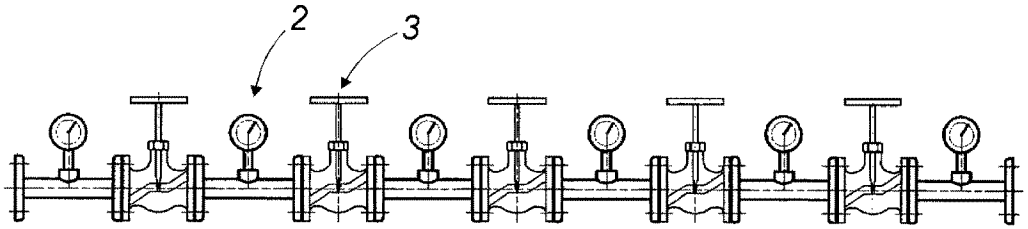
FIG. 2 shows an example of the device with needle valves (3) and intermediate pressure gauges (2).

On a platform with injection into 4 wells, the water pump pressure is 160 bars. The well pressures are 130, 125, 120, 110 bars.

Laboratory tests with injected brine have identified a polymer (FLOPAM®, Na acrylamide/acrylate copolymers with a molecular weight of 20 million) concentration of 800 ppm for a final viscosity of 21 cps and an oil viscosity of 20 cps. The well injection flow rate is 19 $m^3$/h.

Four pressure reducers are constructed consisting of 6 straight rectilinear tubes with a length of 30 cm and an internal diameter of 20 mm separated by 14 mm gate valves.

These reducers are installed on the 4 wells and the ΔP is adjusted by section using pressure gauges as follows:

Well at 130 bars: 5 bars;

Well at 125 bars: 7 bars;

Well at 120 bars: 8 bars;

Well at 110 bars: 10 bars.

The injection pressure is then finally adjusted by slightly modifying these values.

Samples are taken at the wellhead using a standard API RP63 section 6.4 sampling device. The following degradation levels are measured:

At 130 bars: unmeasurable;

At 125 bars: very low (1-2%);

At 120 bars: 2%;

At 110 bars: 4%.

That is perfectly acceptable.

Upon injection each device can be adjusted to the required pressure with ease, either manually or by means of a PLC, thus giving the necessary injection value.

Example No. 2

On the same wells, a pressure reducer comprised of 5 half-inch diameter needle valves is installed. After adjusting the pressure, the following levels of degradation are measured:

At 130 bars: very low;

At 125 bars: 1 to 2%;

At 120 bars: 3%;

At 110 bars: 6%.

What is claimed is:

1. A pressure regulating device for the injection of an aqueous polymer solution into an oil well, said device comprising from 3 to 20 valves and a series of straight tubes each with a pressure gauge, each tube being separated by one of said valves, characterized in that the valves are needle valves, wherein each tube is separated from each adjacent tube by only said valve, and wherein the series of tubes has an inner diameter with no restrictions in diameter disposed therein.

2. The device according to claim 1, characterized in that a length of the each of the straight tubes is between 10 and 50 centimeters.

3. The device according to claim 1 characterized in that the straight tubes are made of stainless steel.

4. A method to reduce the injection pressure of an aqueous polymer solution according to the pressure of the well using the device of claim 1, within an enhanced oil recovery method.

5. The method according to claim 4, characterized in that the method comprises the following steps:

calculating the required pressure reduction by subtracting the injection pressure at the wellhead from the pressure of the main injection pump;

determining the diameter, the number of straight tubes and the length of the pressure regulating device at the injection flow rate, by way of workshop tests;

injecting the aqueous polymer solution into the main pipeline;

adjusting the pressure drop per straight tube by way of measuring the pressure at each straight tube and associated valve using the pressure gauge and by way of balancing said pressure drop between the straight tubes using various valves.

6. The device according to claim 3 characterized in that the straight tubes are made of austenitic-ferritic steel.

7. The device according to claim 3 characterized in that the straight tubes are made of surface-hardened austenitic steel.

* * * * *